US006655253B2

(12) United States Patent
Uchida et al.

(10) Patent No.: US 6,655,253 B2
(45) Date of Patent: Dec. 2, 2003

(54) ENVELOPE MANUFACTURING METHOD BY BRAIDER

(75) Inventors: Hiroshi Uchida, Omihachiman (JP); Tadashi Uozumi, Kyoto (JP); Masahiko Onda, Tsukuba (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 100 days.

(21) Appl. No.: 10/011,312

(22) Filed: Dec. 11, 2001

(65) Prior Publication Data

US 2002/0069750 A1 Jun. 13, 2002

(30) Foreign Application Priority Data

Dec. 13, 2000 (JP) ..... 2000-378550

(51) Int. Cl.[7] ..... D04C 1/06
(52) U.S. Cl. ..... 87/6; 87/9
(58) Field of Search ..... 87/6, 7, 8, 9, 11, 87/13, 30, 33, 34, 41, 62

(56) References Cited

U.S. PATENT DOCUMENTS 5,070,914 A * 12/1991 Fukuta et al. ..... 139/384 R
5,392,683 A 2/1995 Farley ..... 87/8
5,619,903 A * 4/1997 Rogers et al. ..... 87/7
5,979,288 A * 11/1999 Gallagher et al. ..... 87/36
6,325,822 B1 * 12/2001 Chouinard et al. ..... 623/1.15

FOREIGN PATENT DOCUMENTS

| | | |
|---|---|---|
| EP | 0322821 A1 | 7/1989 |
| JP | 11-240078 | 9/1999 |
| JP | 11-262955 | 9/1999 |
| WO | WO 96/10666 | 4/1996 |

OTHER PUBLICATIONS

European Search Report dated Apr. 18, 2002.

* cited by examiner

*Primary Examiner*—John J. Calvert
*Assistant Examiner*—Shaun R Hurley
(74) *Attorney, Agent, or Firm*—Armstrong, Westerman & Hattori, LLP

(57) ABSTRACT

An airship envelope manufacturing method uses a braider such that the envelope is formed as one object composed by the braider. A pair of braiding materials, whose braiding angle is ±θ° to the axis, and an axial material whose angle is 0° to the axis, are organized as the braiding layer by the braider BR and the envelope En shaped like the airship is composed as one body by the braiding layer. The thickness of the braiding layer in both of the axial end parts of the airship envelope is arranged to be formed thinner than the thickness in the axial central part. The three braiding layers can be a spindle-shaped tape made of a plurality of parallel fibers having non-identical lengths, and the width of the spindle-shaped tape along the airship axis can be a function of an airship diameter along the airship axis.

4 Claims, 9 Drawing Sheets

ENVELOPE MANUFACTURING METHOD BY BRAIDER

TECHNICAL FIELD

The present invention relates to a manufacturing method of the envelope membrane for airship or the like in conjunction with the development of Stratospheric Platforms, particularly an envelope manufacturing method using a braider such that the envelope membrane for the airship is formed as one body by the braider.

BACKGROUND ART

In recent years, research and development on Stratospheric Platforms has progressed exponentially and come under close scrutiny as an alternative system to communications and weather satellites in the communications and weather observation fields. The Stratospheric Platforms technique is used for example, for communications and broadcasting, earth observation and astronomical observation by staying the unmanned airship carrying a communications machine and the observation sensor in the stratospheric altitude of about 20 km whose weather condition is relatively stable. Therefore, the airship has to be made of light and strong materials and it is necessary to be formed as one body without patching divided membranes.

So far, the envelope of the airship manufactured for Stratospheric Platforms is formed by a poly-divide gore G and the poly-divide gore is welded along the welding line, as shown in FIG. 12. Since the airship envelope made by welding these poly-divide gores together is welded to form by patching the poly-divide gores, there is a big problem with the strength when using for an airship envelope.

SUMMARY OF THE INVENTION

The present invention is made to solve the problems of the aforementioned conventional art, and it is an object of the present invention to provide an envelope manufacturing method using a braider such that the envelope like the airship and the balloon, made by using light and strong materials, is formed as one body composed by the braider without patching together divided objects.

To achieve the abovementioned object, the present invention manufacturing method uses the braider such that a pair of braiding materials whose braiding angle is $\pm\theta°$ to the axis and an axial material whose angle is 0° to the axis are organized as the braiding layer by the braider and the envelope like the airship is composed as one body by the aforementioned braiding layer.

Further, the present invention contemplates that the braiding material and the axial material mentioned above are tape-shaped, and the tape-shaped material gradually becomes narrower from the longitudinal central part to both longitudinal end parts and the spindle-shape tape gradually becomes thinner from the longitudinal central part to the longitudinal both end parts.

Furthermore, the present invention contemplates that the thickness of the braiding layer in the axial both end parts of the aforementioned envelope is formed thinner than the thickness in the axial central part.

BRIEF DESCRIPTION OF THE DRAWING FIGURES

FIGS. 3A and 3B show an example of a sheet material becoming the basis for forming the spindle-shape tape for a pair of the braiding material and the axial material, wherein FIG. 3A is a schematic plan view showing an embodiment wherein the spindle-shape tape is formed by being slit from the sheet material and FIG. 3B is the central longitudinal section of the same embodiment.

FIGS. 4A through 4D show an embodiment of the spindle-type tape for a pair of the braiding material and the axial material, wherein FIG. 4A is a schematic plan view of the spindle-type tape and FIG. 4B is a schematic one side view and FIG. 4C is a schematic perspective view showing the embodiment of the bobbin wound from this spindle-shaped tape and FIG. 4D is a schematic cross section of the bobbin of FIG. 4C.

Figure 5:
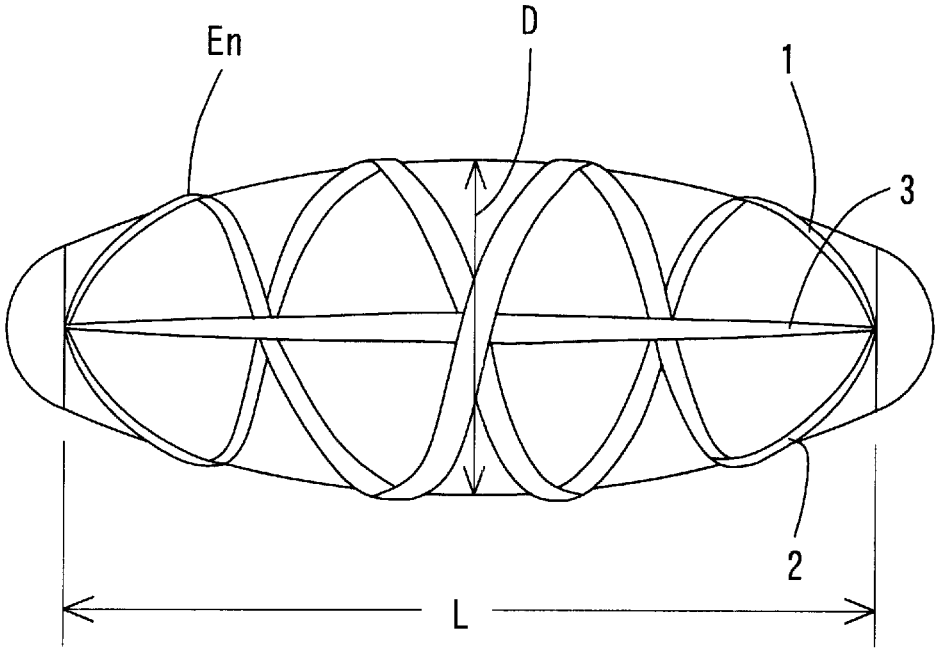

FIG. 5 is a schematic side view showing the composition method of a pair of the braiding materials and the axial material in the composition method of the airship envelope.

Figure 6:
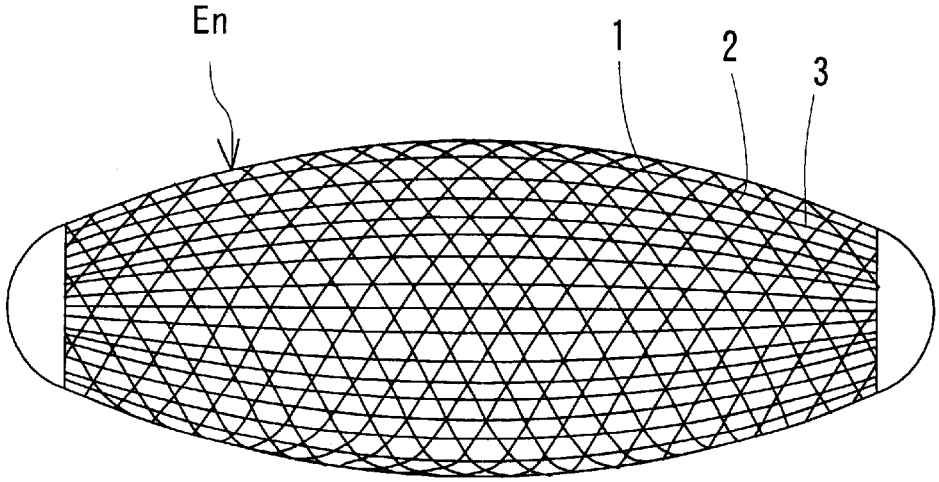

FIG. 6 is a schematic side view showing one composition example of the airship envelope composed by the braiding.

Figure 7:
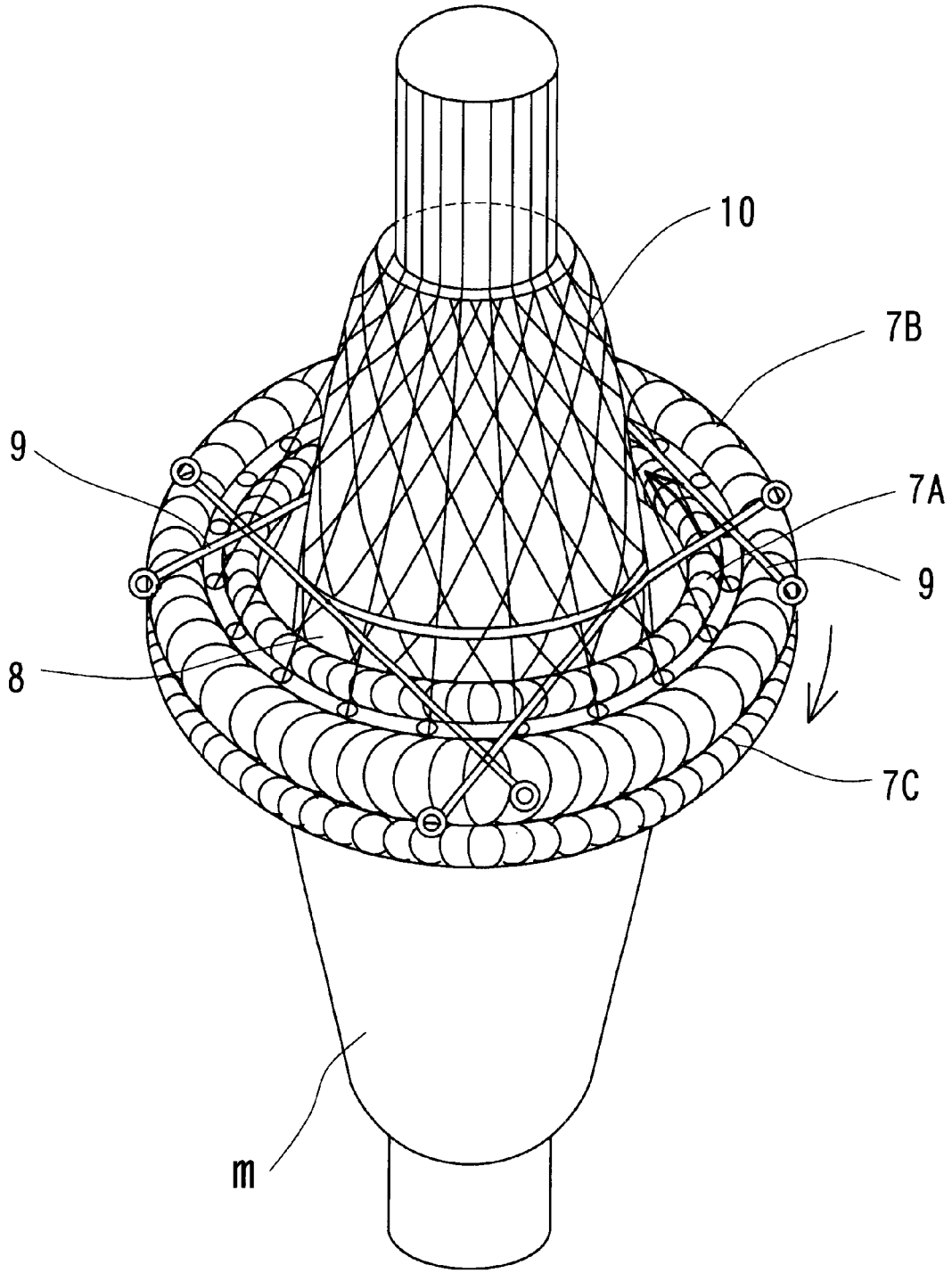

FIG. 7 is a schematic perspective view showing the main part of the state that the bobbin 7 is set to the braider BR.

Figure 8:
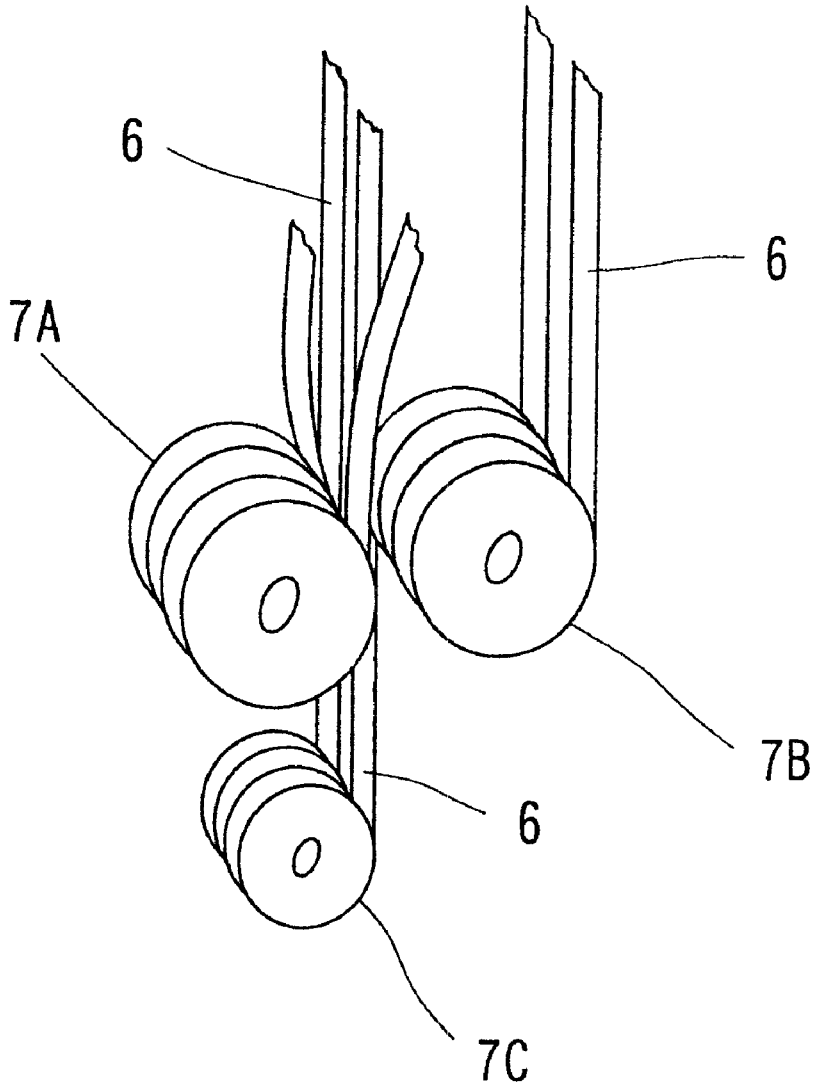

FIG. 8 is a schematic perspective view showing the arrangement relation between the bobbin pair of the braiding materials and the bobbin of axial material.

Figure 9:
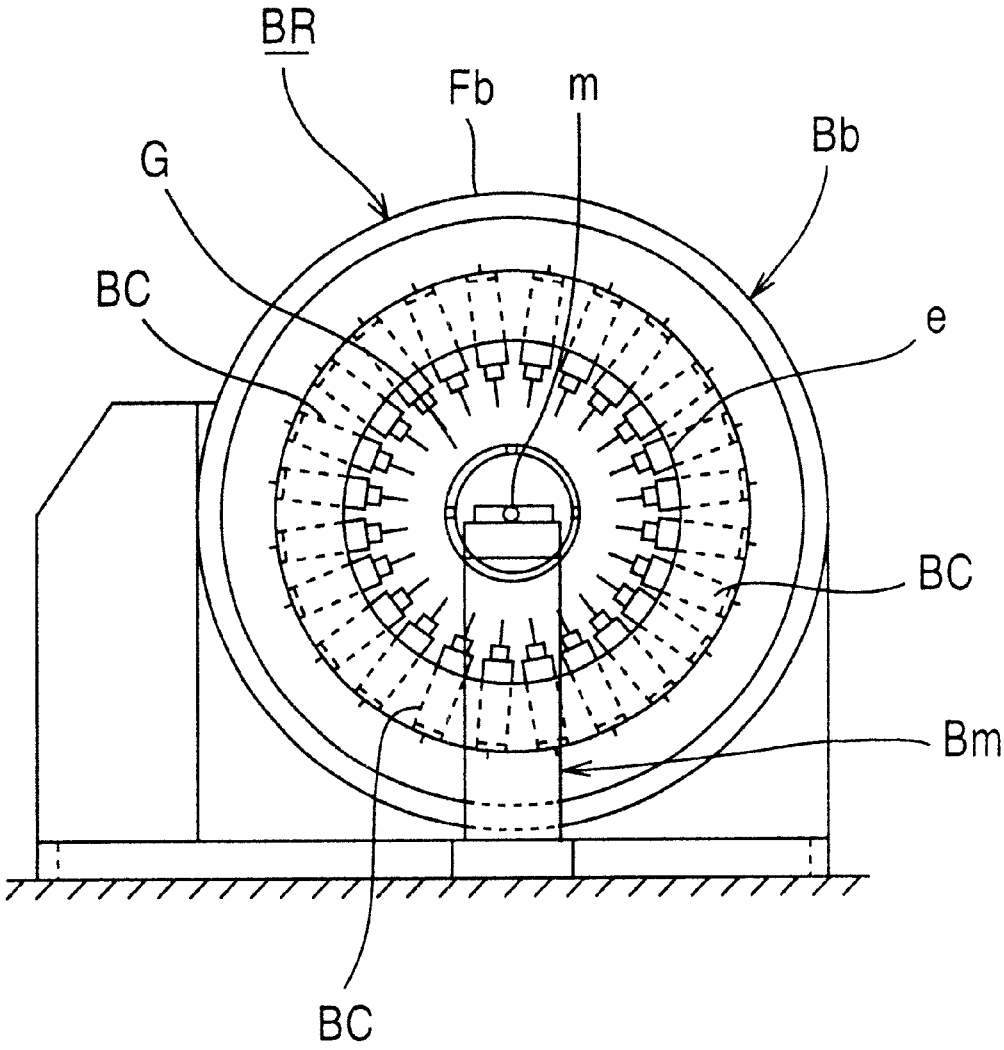

FIG. 9 is a schematic front view showing an example of the basic composition of the braider.

Figure 10:
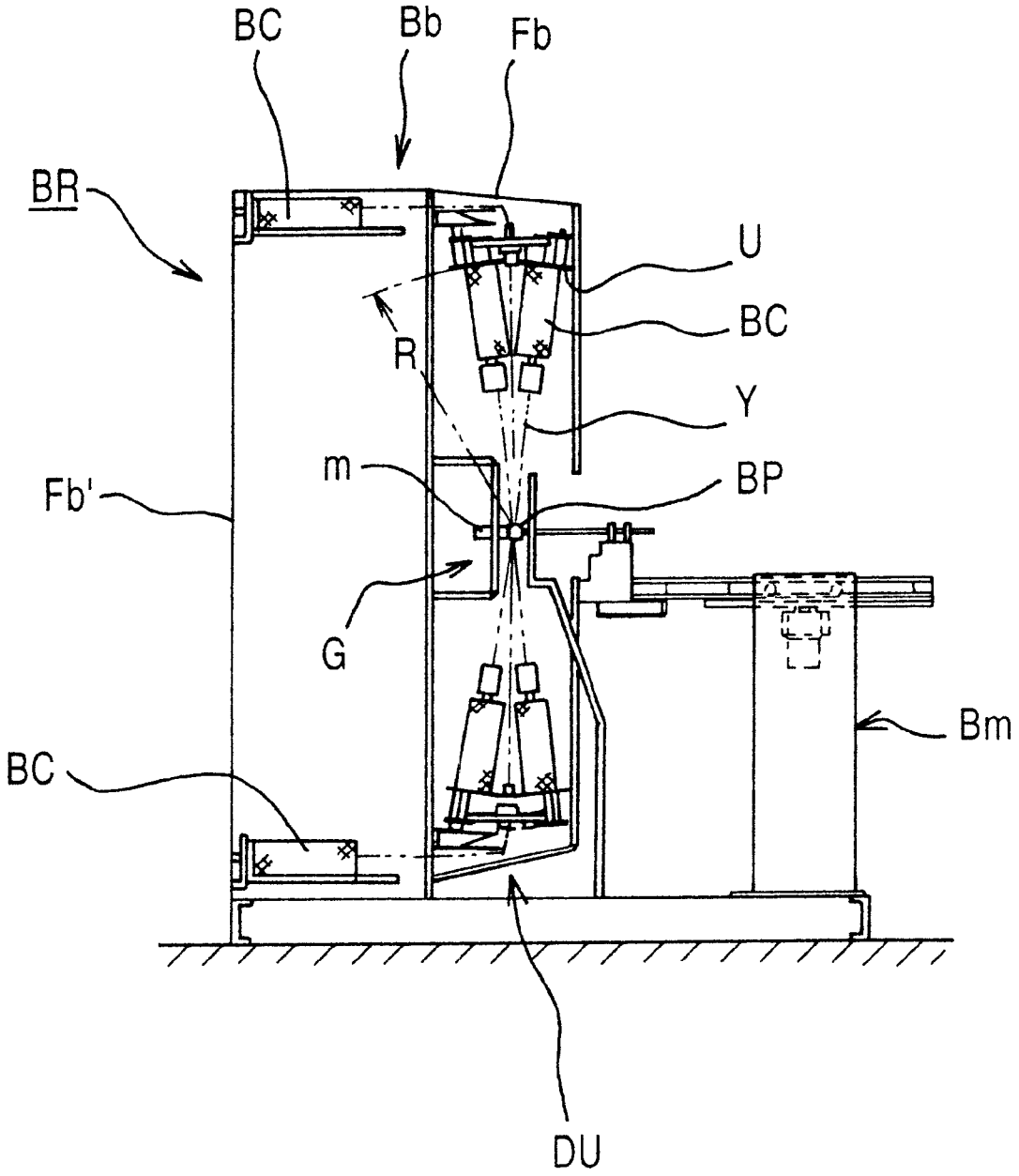

FIG. 10 is a schematic sectional side view of the braider shown in FIG. 9.

Figure 11:
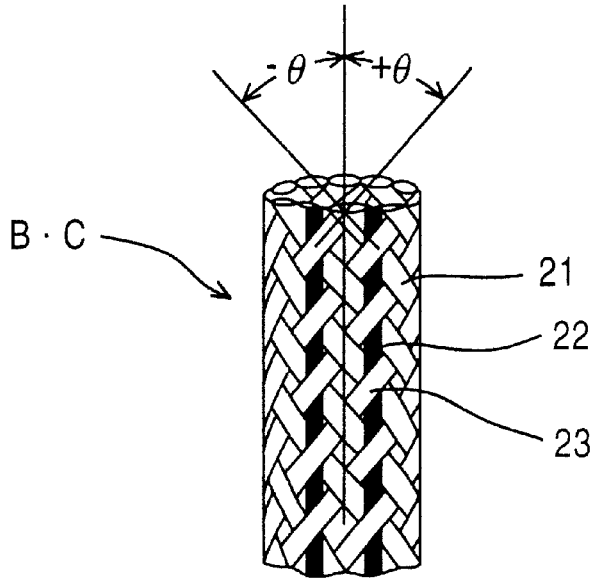

FIG. 11 is a schematic perspective view showing a typical example of the composition composed by the braider.

Figure 12:
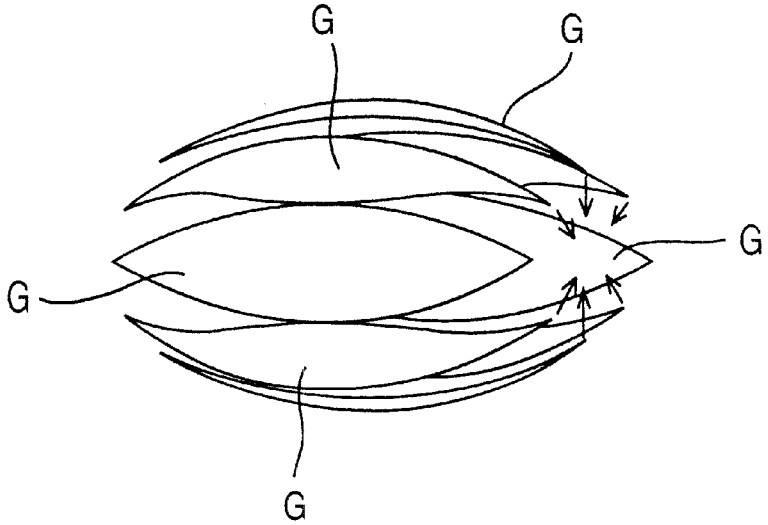
FIG.12 PRIOR ART

FIG. 12 is a schematic perspective view showing an example of composing said airship envelope by poly-divide gore according to the conventional manufacture of the airship envelope.

DETAILED DESCRIPTION

Figure 1:
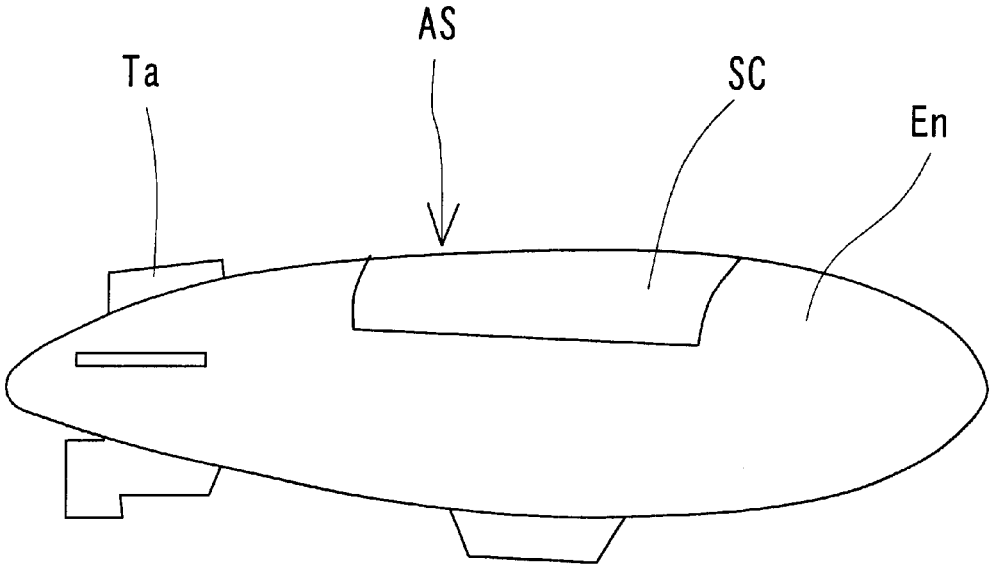
FIG. 1 is a schematic outside drawing showing an airship relating to one application example of the present invention.
Figure 2:
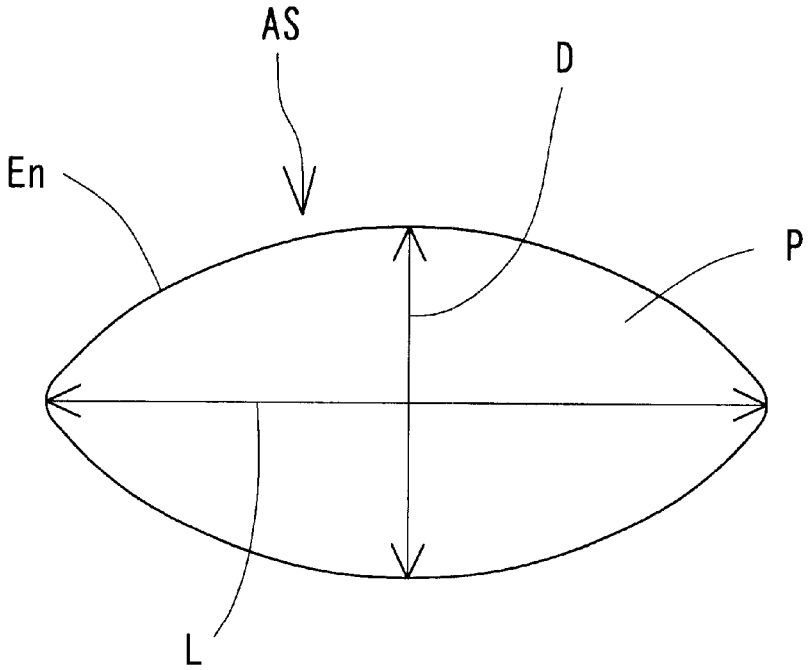
FIG. 2 is a schematic explanatory drawing for explaining an applied calculation in the embodiment of said FIG. 1 airship.

Hereafter, the envelope manufacturing method of the airship, balloon etc. by the braider according to the present invention will be described based on the concrete embodiment shown in the drawings. FIG. 1, relating to one application example of the present invention, is a schematic outside drawing showing the concrete embodiment of the airship. FIG. 2 is a schematic explanatory drawing for explaining the applied calculation in the concrete embodiment of the airship.

An airship AS shown in FIG. 1 shows one application example of the present invention, and the present invention is not confined to the envelope for the above airship but can be also applied to the envelope for balloons and the like. The airship AS relating to one application example of the present invention, equipped with an envelope En mainly composed of the gasbag and a tail assembly Ta and formed by the pressure membrane structure filled with the lifting gas composed of the helium gas etc. in it, is formed such that it goes up by the surplus buoyancy of the helium gas in the gasbag in the envelope En and is stayed in the stratosphere about 20 to 22 km from the ground emitting the lifting gas of the surplus buoyancy at the mission altitude and goes down by the tare by discharging a part of the helium gas. Moreover, the sunlight can be stably used as the energy source in this airship because of the favorable weather in the stratosphere, so that a solar battery SC is arranged to be disposed on the outer surface of the upper part of the envelope En.

On the other hand, the design of the envelope En in the abovementioned airship can be set based on the applied calculation of the airship. As shown in FIG. 2, the stress to the envelope in the airship includes the diameter direction stress and the axial direction stress. If the diameter of the airship is D and the length of the airship is L and the internal pressure of the airship is P, a diameter direction stress Sd is $Sd=(D/2)\times P$ and an axial direction stress Sa is $Sa=(D/4)\times P$. In other words, since the stress becomes weaker as the diameter D of the airship becomes smaller, the thickness can be designed thinner from the axial central part to the axial end part sides of the airship.

The design conditions mentioned below are especially required in the envelope En in the aforementioned airship. These conditions are (1) the material is light and strong, (2) there is no need to provide a margin for paste and a seam, for making the envelope light to the utmost limit, (3) the thickness required is minimum, (4) the cut part of the material is minimized and (5) it is possible to be manufactured as one body etc.

Therefore, it is an ideal that the airship envelope is manufactured by the braider. According to the manufacture of the airship envelope by this braider, (1) light and strong materials can be applied, (2) the margin for paste and a seam etc. is not needed and it can be light to the utmost limit, (3) it can be composed of a minimized membrane, (4) the cut part of the material can be diminished and (5) it is possible to be manufactured as one body. Furthermore, the aforementioned stress can be made to correspond to a changing the thickness of a thin material, using the thin material as the braiding material and the axial material.

Next, the concrete structural example of the aforementioned braider and the composition composed by the braider will be described in detail with reference to FIG. 9, FIG. 10 and FIG. 11. FIG. 9 is a schematic front view showing an example of the basic structure of the braider, and FIG. 10 is a schematic sectional side elevation of the braider shown in FIG. 9. FIG. 11 is a schematic perspective view showing a typical example of the composition composed by the braider.

First, one structural example of the braider will be described with reference to FIG. 9. A braider BR consists of a braider main body Bb and a mandrel device Bm in FIG. 9 and FIG. 10.

The braider main body Bb in the braider BR has a curved top plate U of a curvature radius R arranged in an almost cylindrical machine Fb where the axis is horizontal and an opening e is provided in one side, a bobbin carrier BC traveling along the track made to the circumferential direction of the top plate U, a drive unit DU in order for the bobbin carrier BC to travel along the track and a yam guide apparatus G.

Moreover, the material Y pulled from the bobbin placed in the bobbin carrier BC to the axial direction of the bobbin is assembled to almost center of the top plate U, and the position of a mandrel m installed in the mandrel device Bm is arranged such that a build up point BP of the braiding formed on the mandrel m is positioned in the center of the top plate U. The mandrel device Bm can be controlled to position the mandrel m in one, two and three dimensions.

The bobbin carrier BC is driven along the track by the drive unit DU and the position of the mandrel m is controlled by the mandrel device Bm, so that the numerous materials Y are complicated and the braiding layer can be built up on the various shaped mandrel conducting the braiding by that the material for axial material Y from the bobbin carrier BC arranged almost horizontally to a frame Fb' of the machine Fb is confounded to the material Y rewinded and built up from the bobbin carrier BC traveling along the track, if necessary.

Next, the basic structural example of the braiding composition composed by the above-described braider will be described in detail with reference to FIG. 11. Braiding compositions B, C shown in FIG. 11 are composed as a cylindrical (pipe-shaped) composition. In the example shown in FIG. 1, the aforementioned braiding compositions B, C are organized by a pair of the braiding materials 21, 23 whose braiding angle to the axis are $\pm\theta°$ and a axial material 22 whose angle is 0° to the axis.

According to one example of the present invention, the envelope En of the airship AS is composed with the braiding compositions B, C becoming the abovementioned basic composition by the abovementioned braider. Hereafter, the manufacturing method of the envelope En for the airship and the like by the braider BR in relation to the present invention will be described.

Figure 3:
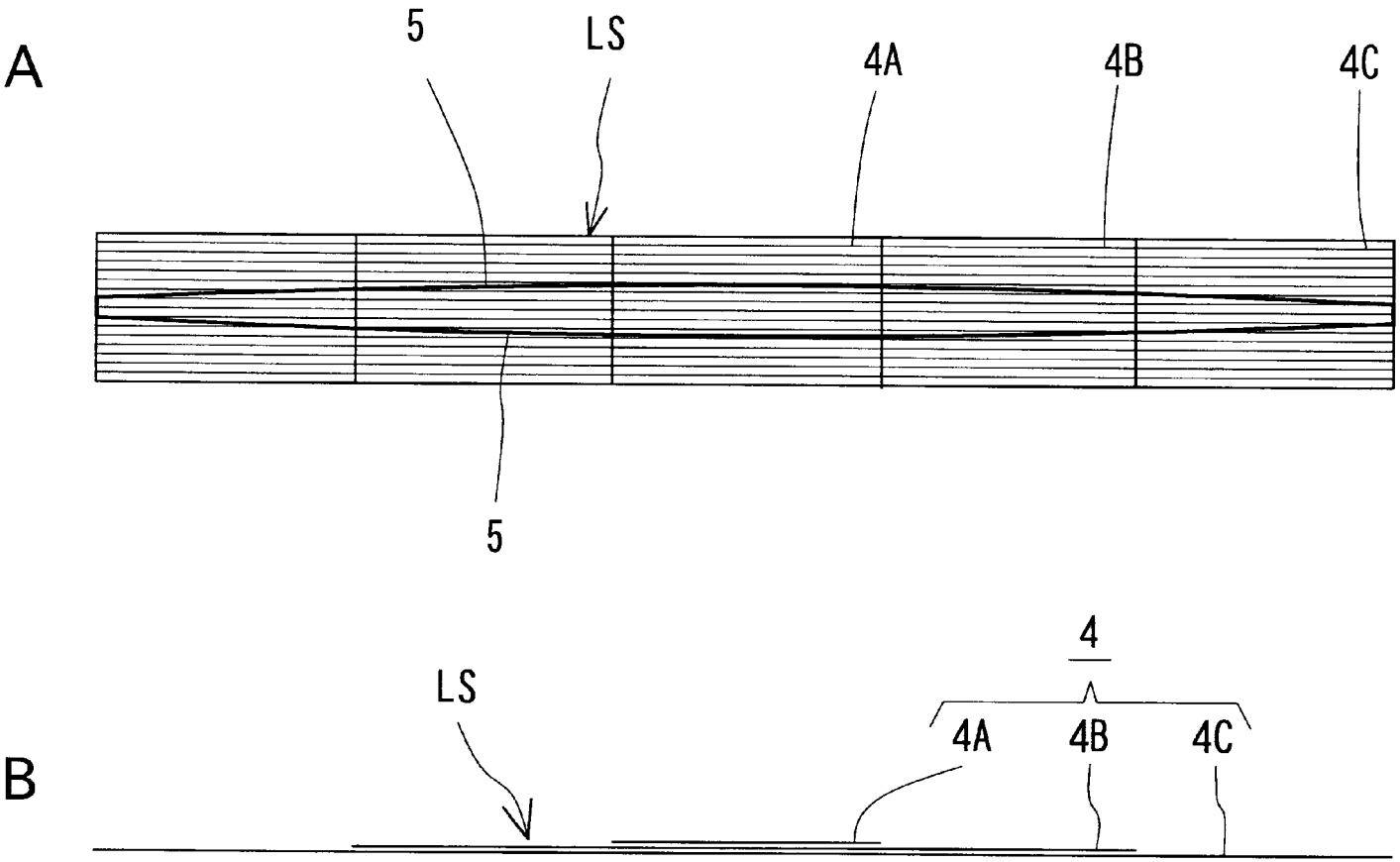

First, in an embodiment of the present invention, the structural example of a pair of the braiding materials 1, 2 and the axial material 3 used for the braider BR for manufacturing the airship envelope En will be described with reference to FIG. 3 and FIG. 4. According to the present invention, the pair of braiding materials 1, 2 and the axial material 3 are formed according to the tape-shaped material which gradually becomes narrower from the longitudinal central part to both longitudinal end parts and this the spindle-shaped tape which gradually becomes thinner from the longitudinal central part to both the longitudinal end parts.

For example, as shown in FIG. 3A and FIG. 3B, the aforementioned braiding materials 1, 2 and 3 are formed from a sheet material 4 whose thickness is about 0.1 mm by combining strands of materials like Kevlar and Xyron in flat condition. Sheets 4A, 4B, 4C whose lengths are different are formed from this sheet material 4 to make a laminating sheet LS which gradually becomes thinner from the longitudinal central part to both the longitudinal end parts and is formed by connecting the sheets 4A, 4B, 4C in the laminating state. According to the example shown in the drawings, the thickness t of the aforementioned laminating sheet LS is about 0.3 mm in the longitudinal central part, and is about 0.1 mm in both the longitudinal end parts.

Figure 4:
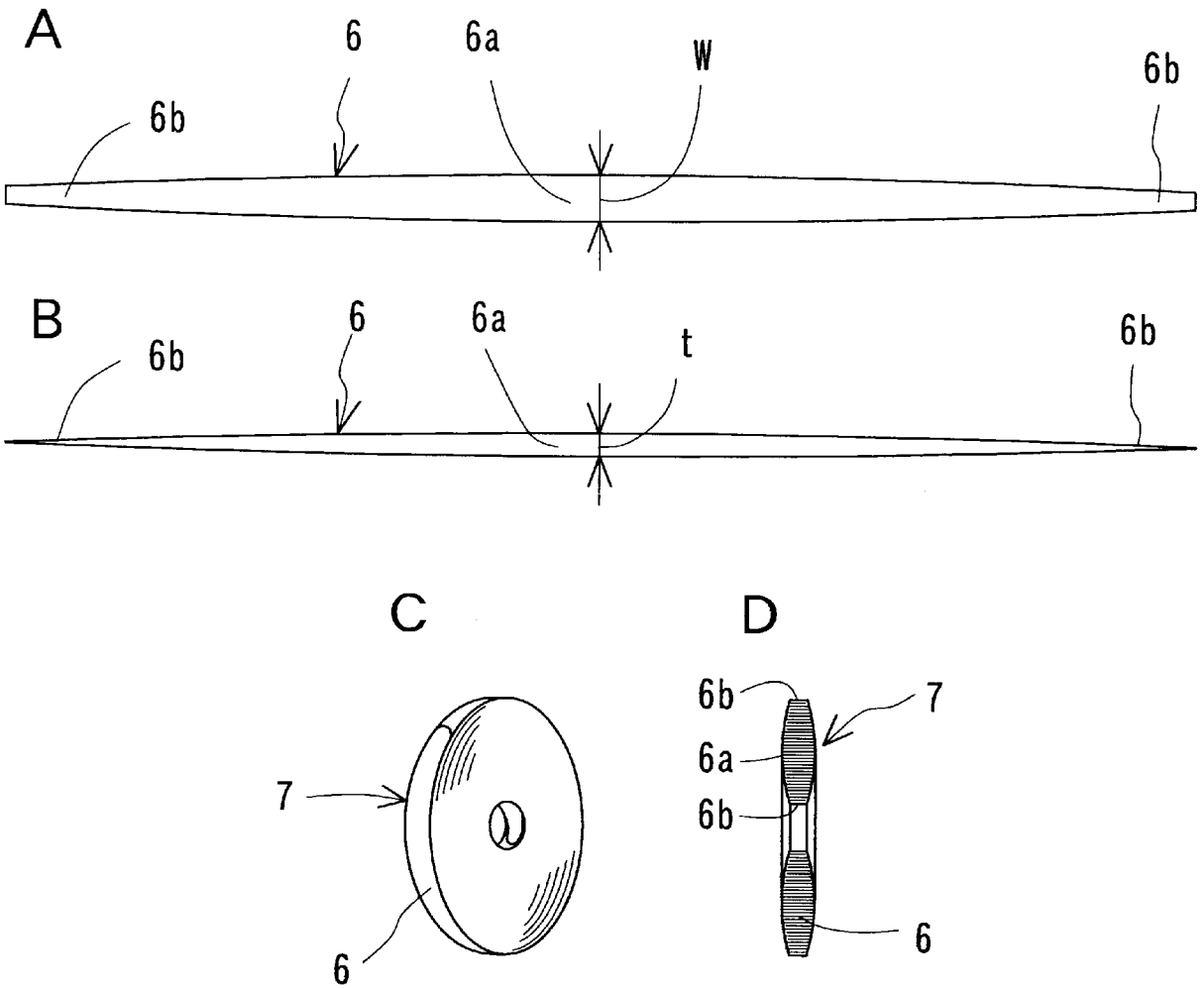

This laminating sheet LS is slit such that the width W gradually becomes narrower from the longitudinal central part to both of the longitudinal end parts along a curved slit line 5 as shown in FIG. 3A and it is formed to a spindle-shaped tape 6 as shown in FIG. 4. In other words, the spindle-shaped tape 6 is prepared as a composition which gradually becomes narrower from a longitudinal central part 6*a* to a both longitudinal end parts 6*b*, 6*b* and gradually becomes thinner from the longitudinal central part 6*a* to both of the longitudinal end parts 6*b*, 6*b*.

This spindle-shaped tape 6 is prepared as a bobbin 7 as shown in FIG. 4C and FIG. 4D in order to be set in the braider BR, formed to a length such that it can be composed as sequential braiding materials 1, 2 and the axial material 3 to the length L and the diameter D of the composed airship envelope En.

The bobbin 7 prepared like this from the spindle-shaped tape 6 is set in the braider BR. FIG. 7 schematically shows the main part of the state in which the bobbin 7 is set to the braider BR, and FIG. 8 schematically shows the arrangement relation between the bobbin 7 as a pair of the braiding materials 1, 2 and the bobbin 7 as the axial material 3. In FIG. 7, numerous bobbins 7A as a braiding material 1, whose braiding angle is +θ° to the axis, are set along the circumference around it to the mandrel m for the composed airship envelope En, and numerous bobbins 7B as the braiding material whose braiding angle is θ° to the axis are set, and more, numerous bobbins 7C as the axial material whose angle to the axis is 0° are set along the other circumference.

The squeezing is conducted by a squeezing means 9 composed of the squeezing wire to an organization part 8 mounted on the aforementioned mandrel m by the spindle-shaped tape 6 wound off respectively from the aforementioned bobbins 7A, 7B, 7C, so that a composition 10 is organized. The composition 10 organized like this is arranged to be coated with resin.

In an embodiment shown in FIG. 7, for example, the aforementioned mandrel m is formed by the composition like a balloon with air, and the air is pulled out and can be extracted from the composed composition 10 after the braiding by a pair of the braiding materials and the axial materials.

As seen in the example mentioned above, the present invention is organized as the braiding layer of a pair of braiding material whose braiding angle is ±θ° to the axis and an axial material whose angle is 0° to the axis by the braider and the airship envelope can be composed as one body by this braiding layer and the aforementioned pair of the braiding material and the axial material gradually becomes narrower from the longitudinal central part to the both longitudinal end parts and it is formed by the spindle-shaped tape which gradually becomes thinner from the longitudinal central part to both the longitudinal end parts, so that the thickness of the braiding layer in the axial both end parts of the airship envelope can be formed thinner than the thickness in the axial central part.

According to the envelope manufacturing method by the braider of the present invention as described above, (1) light and strong materials can be applied, (2) the margin for paste and a seam is not needed and the envelope can be light to the utmost limit, (3) it can be required minimum thickness, (4) the cut part of the material can be diminished, and (5) it can be manufactured as one body, and furthermore, it can act so effectively that the aforementioned stress can be made to correspond to a changing thickness of the thin material using the thin material as the braiding material and the axial material.

What is claimed is:

1. A one-body braided envelope for an airship, the airship having an axis; the envelope comprising:

a pair of braiding materials whose braiding angle is ±θ° to the axis and an axial material whose braiding angle is 0° to the axis, formed as a braided layer of the envelope;

wherein the braiding material and the axial material each respectively comprise a spindle-shaped tape having a width becoming gradually less from a longitudinal central part of the tape to both longitudinal end parts of the tape.

2. The envelope according to claim 1, wherein the spindle-shaped tape has a thickness becoming gradually less from the longitudinal central part to both of the longitudinal end parts.

3. The envelope according to claim 1, wherein the spindle-shaped tape comprises a plurality of parallel fibers having non-identical lengths.

4. The envelope according to claim 1, wherein the width of the spindle-shaped tape along the airship axis is a function of an airship diameter along the airship axis.

* * * * *